US006559592B1

(12) United States Patent
Lee

(10) Patent No.: US 6,559,592 B1
(45) Date of Patent: May 6, 2003

(54) DISPLAY DEVICE WITH COLOR FILTERS USED AS ELECTRODES AND METHOD FOR MANUFACTURING THE SAME

(75) Inventor: Yoon Kwan Lee, Kwangmyoung (KR)

(73) Assignee: LG Electronics Inc., Seoul (KR)

( * ) Notice: Subject to any disclaimer, the term of this patent is extended or adjusted under 35 U.S.C. 154(b) by 58 days.

(21) Appl. No.: 09/677,760

(22) Filed: Oct. 3, 2000

(30) Foreign Application Priority Data

Oct. 4, 1999 (KR) ..... 99-42653

(51) Int. Cl.[7] ..... H01J 17/02; H01J 61/40

(52) U.S. Cl. ..... 313/495; 313/491; 313/587; 313/112; 313/503; 313/581

(58) Field of Search ..... 313/581, 582, 313/583, 584, 585, 502, 503, 498, 112, 587, 506, 495, 491, 489

(56) References Cited

U.S. PATENT DOCUMENTS 5,248,576 A * 9/1993 Yokoymama et al. ..... 430/7
6,013,983 A * 1/2000 Asano et al. ..... 313/581

* cited by examiner

*Primary Examiner*—Ashok Patel
(74) *Attorney, Agent, or Firm*—Fleshner & Kim, LLP

(57) ABSTRACT

The present invention relates to a display device with a color filter used as an electrode which improves both color purity and optical efficiency of the display device and a method for manufacturing the same. The display device with color filters used as electrodes in accordance with the present invention is achieved by forming conductive color filters on an upper substrate. The fabrication process is simple and accordingly the production yield is increased for thereby reducing the manufacturing cost. In addition, the light transmittance and optical efficiency are increased, and the color purity is increased and external light reflection is effectively shut off.

22 Claims, 6 Drawing Sheets

DISPLAY DEVICE WITH COLOR FILTERS USED AS ELECTRODES AND METHOD FOR MANUFACTURING THE SAME

BACKGROUND OF THE INVENTION

1. Field of the Invention

The present invention relates to a display device and a method for manufacturing the same, and more particularly, to a display device with color filters used as electrodes which improves the color purity and optical efficiency of the display device and a method for manufacturing the same.

2. Description of the Background Art

Flat-panel display devices are generally classified into liquid crystal displays (LCD), field emission displays (FED), plasma display panels (PDP), and electroluminescence (EL).

Among those flat-panel display devices, the plasma display panel (PDP) being actively studied recently has a simple structure, is simply manufactured, has a higher brightness and luminous efficiency as compared to other flat-panel display devices, and can have an additional memory function. In addition, the PDP can implement a large-sized screen of more than 40 inches having a wide field angle of more than 160°. Therefore, the PDP having the above advantages has a potential of driving the flat-panel display market in the future.

When ultraviolet rays generated by gas, e.g., He—Ne or Ne—Xe, during plasma discharge within a discharge cell partitioned by partition walls excite red, green, and blue fluorescent materials formed on the partition walls, visible light generated when the excited fluorescent materials are transited to the ground state is emitted. Using this principle, the PDP displays characters and graphics by means of the emitted visible light. Meanwhile, the PDP is classified into an alternating current PDP (AC-PDP) and a direct current PDP (DC-PDP), said AC-PDP will now be described in more detail.

FIG. 1 is a structural diagram of the AC-PDP illustrating one cell in a general alternating plasma display panel (AC-PDP). The AC-PDP includes a front glass substrate 1 for displaying images, a back glass substrate 23 arranged in parallel to the front glass substrate 1 at a certain distance from the front glass substrate 1, and partition walls 13 positioned between the front glass substrate 10 and the back glass substrate 23 for forming a discharge space in the discharge cell in order to keep the distance between the front and back glass substrates constant and shut off electrical/optical interference between cells.

Here, the front glass substrate 1 further includes: an upper dielectric layer 3 for accumulating wall charges, keeping the discharge voltage, and protecting electrodes from ion bombardment and preventing the diffusion of ions during gas discharge; and a protective layer 9 formed on the surface of the upper dielectric layer 3 for protecting the upper dielectric layer 3 from sputtered plasma particles to thereby lengthen the life span thereof, increasing the relatively high efficiency of the emission of secondary electrons when a low ion energy is bumped against the surface during plasma discharge, and reducing the amount of changes in the discharge characteristics of refractory metals by means of oxides. At this time, the protective layer 9 is mainly made of magnesium oxide (MgO).

In addition, the upper dielectric layer 3 includes a sustain electrode 5, a transparent electrode, made of Indium Tin Oxide (ITO) and a bus electrode 7 made of metal which is connected with the sustain electrode 5.

The back glass substrate 23 includes an address electrode 19 for occurring discharge of the sustain electrode 5 and the bus electrode 7, an under layer 21 for attaching the address electrode 19 and the back glass substrate 23, a lower dielectric layer 17 for covering the address electrode 19, and a fluorescent material 15 for covering the lower dielectric layer 17 and the partition walls 13 formed thereon and generating visible light.

In addition, a black top 11 for absorbing light incident from the outside through the front glass substrate 1 is connected to the upper portion of the wall partition 13.

In the thusly constructed PDP, a discharge is initiated between the address electrode 19 and the sustain electrode 5, in a state that the inner space of the discharge cell is filled with a discharge gas, for example, a gas mixture of He—Ne and Ne—Xe. When the discharge is continuously maintained between the sustain electrodes 5, vacuum ultraviolet (VUV) rays with a wavelength of 147 mm are emitted. Then, the vacuum ultraviolet rays excite the fluorescent material 15. When the fluorescent material 15 is transited from the excited state to the ground state, red, green, and blue visible light is emitted and accordingly desired images are displayed through the front glass substrate 1.

Among the flat-panel display devices, the electroluminescence (EL) are active display devices using the phenomenon that the fluorescent material becomes luminescent by applying an electric field to a conductive fluorescent material coated on a glass substrate or a transparent organic film, which are divided into thin film electroluminescent devices (TFEL), dispersion type electroluminescent devices (EL), and solid state displays (SSD) which are fabricated by improving the thin film electroluminescent devices, said solid state display will now be described in more detail.

FIG. 2 is a structural diagram of a general solid state display, in which a back glass substrate 31, a back electrode 32 formed on the back glass substrate 31, a thick film dielectric layer 33 formed on the back glass electrode 32 for preventing dielectric breakdown, a fluorescent layer 35 formed on the thick dielectric layer 33 for generating visible rays, a thin film dielectric layer 36 formed on the fluorescent layer 35, and a transparent electrode 37 formed on the thin film dielectric layer 33 are stacked one after another. In addition, a planarization layer 34 for planing the interface between the thick film dielectric layer 33 and the fluorescent layer 35 is further stacked between the thick film dielectric layer 33 and the fluorescent layer 35.

The driving principle of the thusly constructed SSD will now be described in brief.

Firstly, when a predetermined voltage (e.g., 22 V) is applied to the back electrode 32 and the transparent electrode 37, electrons are emitted at the interface level of the thick film dielectric layer 33 and the thin film dielectric layer 36 adjacent to the fluorescent layer 35 by means of a tunneling effect. The emitted electrons are accelerated by a high electric field (e.g., $10^6$ V/m) to turn into thermal electrons. The thermal electrons collide with atoms contained in the fluorescent material (e.g., ZnS:Mn) and as a result these atoms become excited. The excited atoms emit visible rays while transiting to the ground state. By this principle, the solid state display displays desired images.

Furthermore, the thick film dielectric layer 33 serves to prevent dielectric breakdown and diffusion between the back electrode 32 and the fluorescent layer 35, stably supply a high voltage, and keep the solid state display's thermal stability.

The PDP and SSD cited among the flat-panel display devices implement all kinds of colors by emitting the corresponding light from red, green, and blue fluorescent materials contained in each cell of the PDP and SSD. However, there occurs a problem that the color purity is reduced due to the phenomenon that colors emitted from the fluorescent materials are mixed with one another. To solve the above problem, color filters are attached on the front glass substrate, said color filters emit the respective colors corresponding to the fluorescent materials for thereby increasing the color purity.

However, in order to increase the color purity, the color filters attached on the front glass substrate of the PDP and SSD still have a problem of decreasing the brightness of the light emitted from the PDP and SSD, as compared to the brightness of the light emitted from the PDP and SSD having no color filter attached on the front glass substrate.

SUMMARY OF THE INVENTION

Accordingly, it is an object of the present invention to provide a display device with color filters used as electrodes for improving the purity of colors displayed by the display device and increasing the optical efficiency.

It is another object of the present invention to provide a method for manufacturing a display device with color filters used as electrodes for improving the purity of colors displayed by the display device and increasing the optical efficiency.

To achieve the above objects, a display device with color filters used as electrodes in accordance with the present invention is formed by forming conductive color filters on an upper substrate.

In the display device with color filter used as electrodes in accordance with the present invention, the color filter is made of a conductive material.

A plasma display panel with color filters used as electrodes in accordance with the present invention is formed by including pairs of sustain electrodes on a back glass substrate and forming color filters used as address electrodes on an upper substrate.

A solid state display device with color filters used as electrodes in accordance with the present invention is formed by forming a back electrode formed on a back glass substrate and color filters on an upper substrate.

A method for manufacturing a display device with color filters used as electrodes in accordance with the present invention includes the steps of preparing a conductive color filter material and forming red, green, and blue filters out of the conductive color filter material.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

Figure 1:
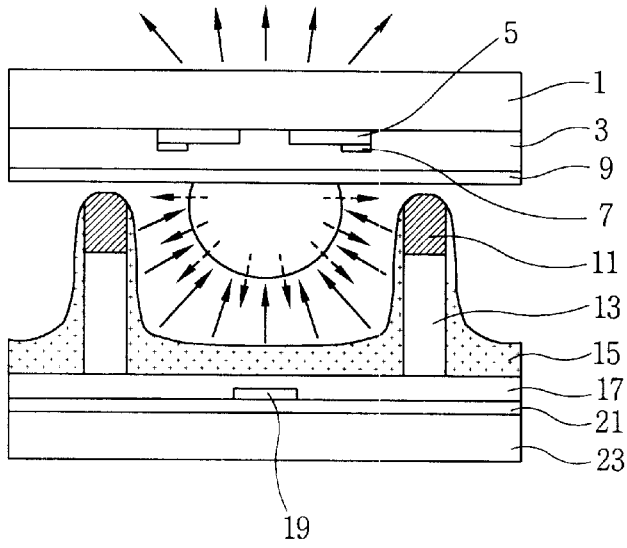
FIG. 1 CONVENTIONAL ART
FIG. 1 is a cross-sectional view illustrating the structure of a conventional PDP.
Figure 2:
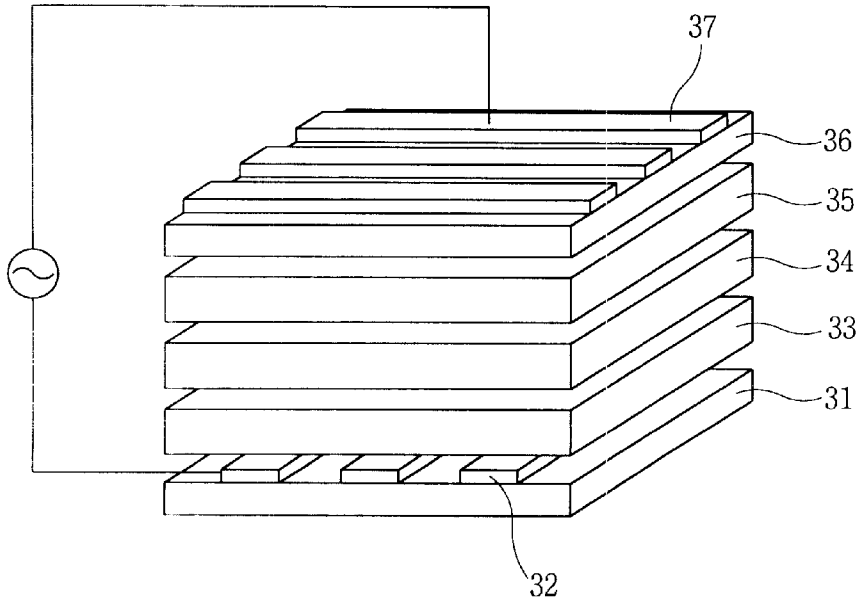
FIG. 2 CONVENTIONAL ART
FIG. 2 is a perspective view illustrating the structure of the conventional PDP.
Figure 3:
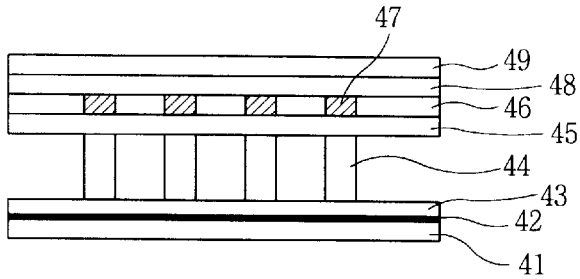
FIG. 3 is a cross-sectional view of a plasma display panel (PDP) with color filters used as electrodes in accordance with the present invention.

FIG. 3 is a cross-sectional view of a plasma display panel (PDP) with color filters used as electrodes in accordance with the present invention. The PDP includes: a back substrate 41 made of glass, glass-ceramic, or metal; pairs of sustain electrodes 42 formed in one direction (e.g., horizontal direction) at a certain distance from each other on the back substrate 41; a lower thick film dielectric 43 formed on the pairs of sustain electrodes; partition walls 44 arranged in a direction orthogonal to the arrangement direction of the pairs of sustain electrodes and installed on the lower thick film dielectric 43; an upper substrate 45 formed on the partition walls; color filters 46 used as address electrodes formed in the same direction (e.g., an orthogonal direction) as the arrangement direction of the partition walls 44; a black matrix 47 formed between the color filters used as electrodes; an upper thick film dielectric 48 formed on the color filters 46; and a fluorescent material 49 formed on the upper thick film dielectric 48.

Each layer of the display device in accordance with one embodiment of the present invention will now be described in more detail.

The pairs of sustain electrodes 42 are formed on the back substrate 41, and the thick film dielectric 43 forming a wall charge is formed on the pairs of sustain electrodes 42.

A protective film (not shown) formed on the thick film dielectric 43 protects the pairs of sustain electrodes 42. Herein, because the sustain electrode 42 can be made of all kinds of conductive metal electrodes as well as a transparent electrode, the discharge voltage can be reduced. In addition, because the thick film dielectric 43, protective film, and the like can be formed on the back substrate, a variety of materials can be used for the above dielectric.

The method for driving a display device in accordance with the present invention thus constructed is identical to the method for driving a conventional PDP, so the description thereof will be omitted.

FIGS. 4A through 4G are perspective views of a PDP which is stacked according to a method for manufacturing a PDP with color filters used as electrodes.

Figure 4A:
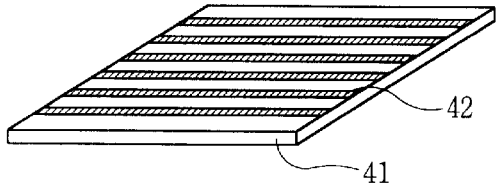
FIGS. 4A through 4G are perspective views of the PDP which is stacked according to a method for manufacturing the PDP with a color filter used as an electrode.

As shown in FIG. 4A, pairs of sustain electrodes 42 is formed on the back substrate 41. Herein, the sustain electrode can be made of a variety of conductive materials, so the PDP is driven at a low discharge voltage, and the productibility of the PDP is increased.

Figure 4B:
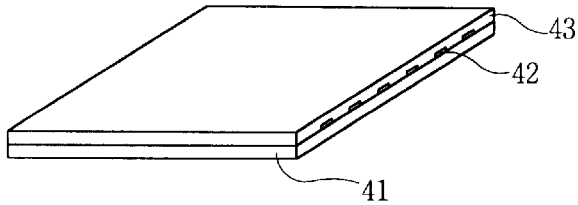

As shown in FIG. 4B, a lower thick film dielectric 43 is formed on the back substrate 41 having the pairs of sustain electrodes. Namely, using screen printing or photosensitive method, a dielectric having a dielectric constant ranging from 10 to 15 is coated on the sustain electrodes 42, and thereafter a protective film (not shown) of about 5000 Å is formed on the lower thick film dielectric 43, in order to keep the discharge voltage. Here, since the lower thick film dielectric 43 and the protective film are formed on the back substrate 41, the restrictions on selecting their materials are reduced.

Figure 4C:
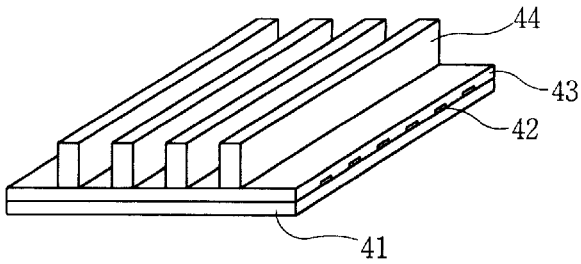

As shown in FIG. 4C, partition walls 44 are formed between the upper substrate 45 and the lower thick film dielectric 43 in a direction orthogonal to the arrangement direction of the sustain electrodes 42. Here, the partition walls 44 form a discharge space.

Figure 4D:
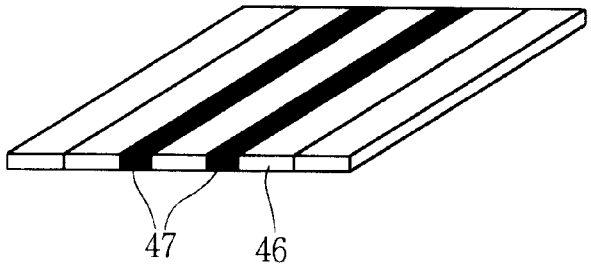

As shown in FIG. 4D, color filters 46 used as electrodes are formed on the upper substrate 45.

Figure 4E:
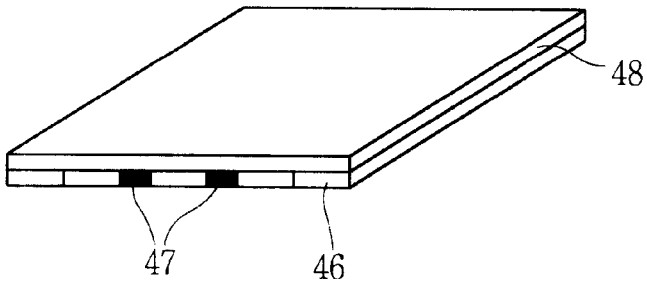

As shown in FIG. 4E, an upper thin film dielectric 48 is formed on the color filters formed on the upper substrate. That is, the upper thin film dielectric 48 has a thickness of a number of $\mu$m, and serves to increase light transmittance and prevent diffusion.

Figure 4F:
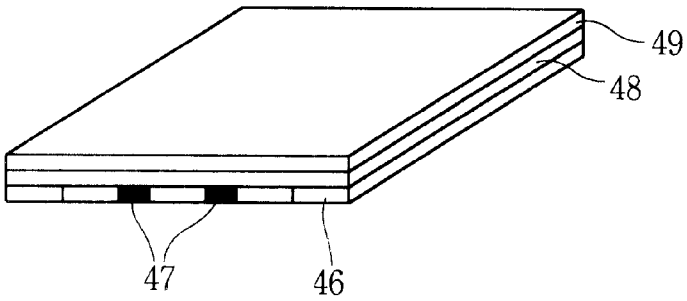

As shown in FIG. 4F, using screen printing or photosensitive method, a fluorescent material 49 is coated on the upper thin film dielectric 48 at a certain thickness.

Figure 4G:
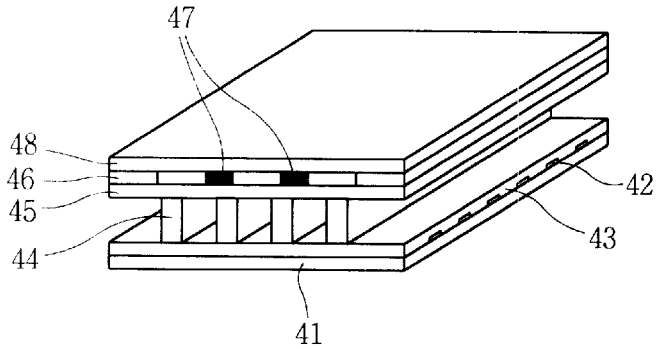

Therefore, by stacking the upper substrate 45 coated with the fluorescent material 49 on the partition walls 44 preinstalled on the back substrate 41, as shown in FIG. 4G, a display device with color filters used as address electrodes in accordance with the present invention is fabricated.

Figure 5A:
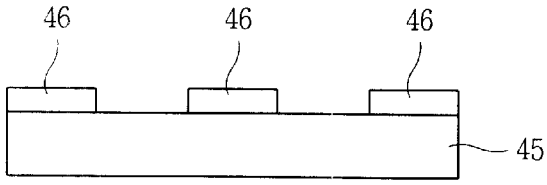
FIGS. 5A and 5B are cross-sectional views of a color filter in accordance with a method for manufacturing a color filter used as an electrode of the present invention.
Figure 5B:
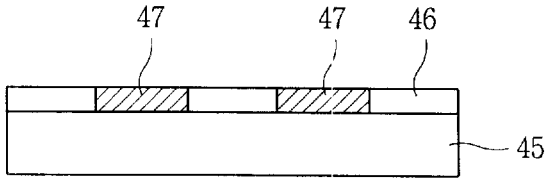

FIGS. 5A and 5B are cross-sectional views of a color filter used as an electrode in accordance with the present invention. Two methods for manufacturing a conductive color filter used as an address electrode will now be described.

(1) The method for forming a color filter used as an electrode by mixing a color filter material with an electrode material are as follows.

As shown in FIG. 5A, using screen printing method, a color filter used as an address electrode is formed by coating a paste of a mixture of a powdery color filter material and a conductive electrode material at a certain thickness (e.g., 3~5 $\mu$m). Here, the electrode material is conductive oxide such as Indium Thin Oxide, SnO, $In_2O_3$ and the like, and, among the color filters, the red filter is made of $\alpha$-$Fe_2O_3$, the green filter is made of $CoOCr_2O_3$, and the blue filter is made of $CoOAl_2O_3$.

After forming the color filters used as address electrodes, as shown in FIG. 5B, a black matrix layer 47 is sequentially formed between the color filters used as address electrodes. Namely, in the color filters used as electrodes in accordance with the present invention, the black matrix layer separating the color filters from one another is formed by a simple process for thereby preventing the reflection of the light incident from the outside and improving the contrast. Here, the black matrix is made of a mixture of PbO type low melting point glass and oxide such as $Co_2O_3$.

However, in the conventional PDP, a black dielectric must be coated on a black top of the partition walls of the PDP, and an additional black matrix layer must be inserted between the upper dielectric layer and the upper substrate. Thus, the process of fabricating the PDP is complicated.

(2) The method for forming a color filter used as an electrode by coating an electrode material on the particles of a color filter material.

Using sputtering or vacuum deposition method, as shown in FIG. 5A, a conductive color filter material is coated on the upper substrate to form a color filter used as an electrode. Here, the conductive color filter material is formed by coating the surface of each particle of the color filter material with the electrode material by pyrolysis, electrophoreis, or dipping method. In addition, the electrode material is conductive oxide such as Indium Thin Oxide, SnO, $In_2O_3$ and the like, and, among the color filters, the red filter is made of $\alpha$-$Fe_2O_3$, the green filter is made of $CoOCr_2O_3$, and the blue filter is made of $CoOAl_2O_3$.

After forming the color filters used as address electrodes, as shown in FIG. 5B, a black matrix layer 47 is sequentially formed between the color filters used as address electrodes.

Therefore, in the display device with color filters used as electrodes in accordance with one embodiment of the present invention, since its fabrication method is simple, and its production yield is high, its manufacturing cost is low. In addition, the sustain electrodes, thick film dielectric, and protective layer are formed on the back substrate, whereby the light transmittance of the upper substrate is improved and accordingly the optical efficiency becomes high.

Figure 6:
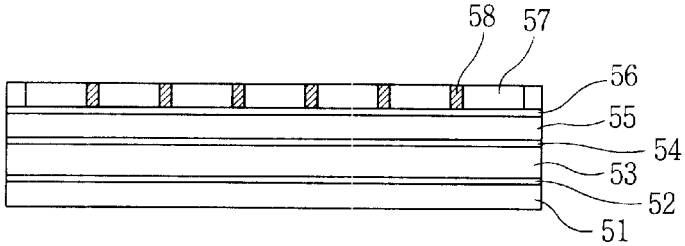
FIG. 6 is a cross-sectional view of a solid state display (SSD) with a color filter used as an electrode.

FIG. 6 is a cross-sectional view of a solid state display (SSD) with color filters as electrodes in accordance with the present invention which includes a back electrode 52 formed on the upper part of the back substrate 51, a thick film dielectric 53 formed on the back electrode 52, a planarization film 54 coated on the entire surface of the thick film dielectric 53, a fluorescent material 55 coated on the planarization film 54, a thin film dielectric 56 formed on the fluorescent material 55, and color filters 57 used as electrodes formed on the thin film dielectric 56.

Here, the thin film dielectric 56 is formed on the fluorescent material 55 to thus prevent diffusion and increase the light efficiency. Between the color filters used as electrodes, a black matrix 58 is formed to thus increase the color purity.

FIGS. 7A through 7E are perspective views of a SSD which is stacked according to a method for manufacturing a SSD with color filters used as electrodes of FIG. 6, which will be described in more detail.

Figure 7A:
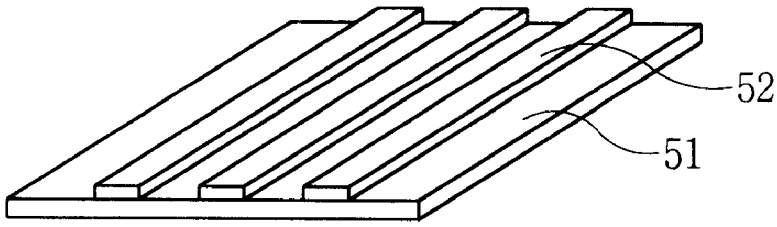
FIGS. 7A through 7E are perspective views of a SSD which is stacked according to a method for manufacturing the SDD with color filters used as electrodes.

As illustrated in FIG. 7A, the back electrode 52 is formed on the back substrate 51 by vacuum deposition or screen printing method. Here, the back substrate 51 is preferably made of aluminum oxide ($Al_2O_3$).

Figure 7B:
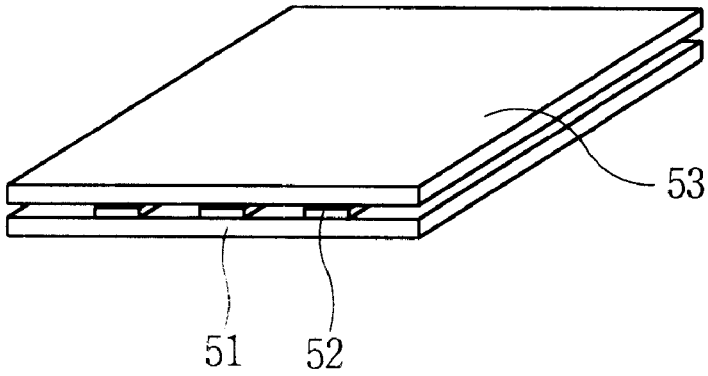

As illustrated in FIG. 7B, the thick film dielectric 53 is coated on the back electrode formed on the back substrate 51. Here, in order to keep a high dielectric breakdown property and a low driving voltage, the thick film dielectric 53 formed by mixing $SrTiO_3$, $PbTiO_3$, and $BaTiO_3$ powder with a diameter of 2–3 $\mu$m with an organic solvent is thickly coated on the back substrate 51 at a thickness of 100–300 $\mu$m, and is baked at a temperature of 900–1000° C. under oxidation atmosphere. At this time, the dielectric strength of the aforesaid materials is $1.0\times10^6$ V/m, and the dielectric constant is about 500~1000.

Figure 7C:
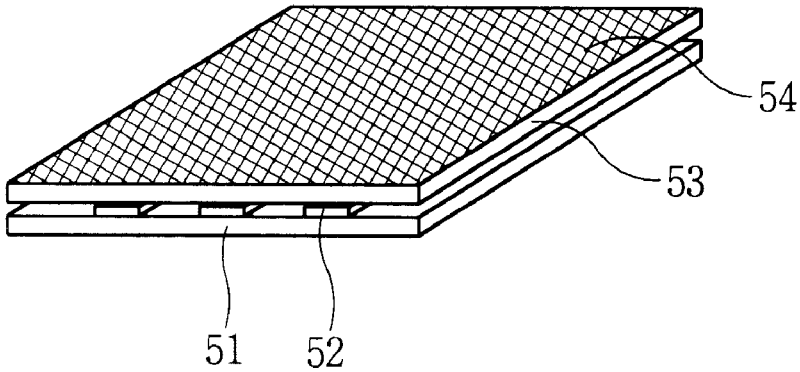

As illustrated in FIG. 7C, a planarization film 54 is formed on the thick film dielectric by Sol-Gel or metallo-organic compound decomposition method.

Figure 7D:
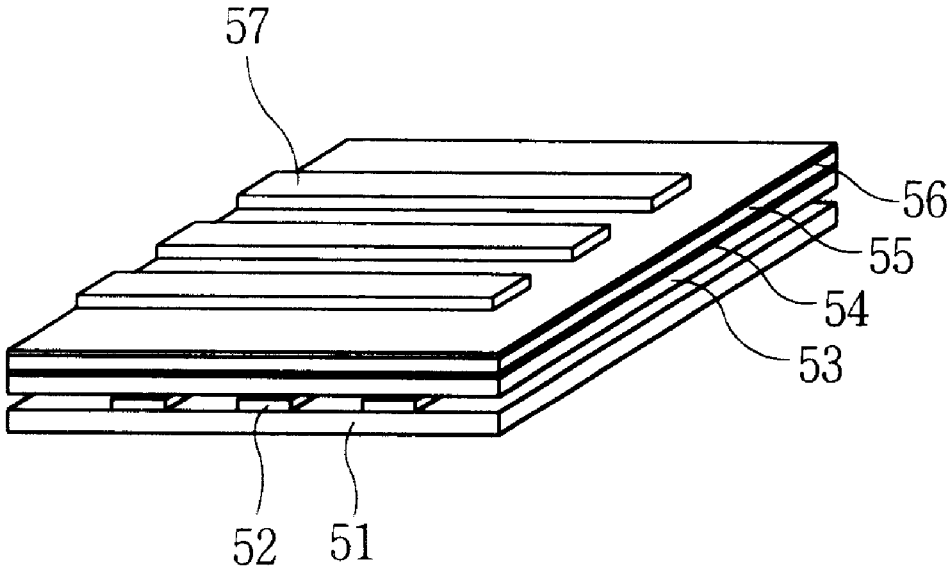

As illustrated in FIG. 7D, red, green, and blue fluorescent materials (R, G, B) are formed on the planarization film 54 in a direction orthogonal to the arrangement direction of the back electrode, and thereafter the thin film dielectric 56 is formed on the fluorescent materials 55.

Here, the fluorescent materials use ZnS as a host, and $Tm^{3+}$ as an activator. The blue fluorescent material contains $Tb^{3+}$ and $Er^{3+}$, the green fluorescent material contains Nd3+, and the red fluorescent material contains $Sm^{3+}$. In addition, the blue-green fluorescent material is formed of a material such as SrS:Ce and SrS:Cl, the green fluorescent material is formed of a material such as Cas:Ce and Cas:Cl, and the red fluorescent material is formed of a material such as CaS:Eu and CaS:Cl.

Figure 7E:
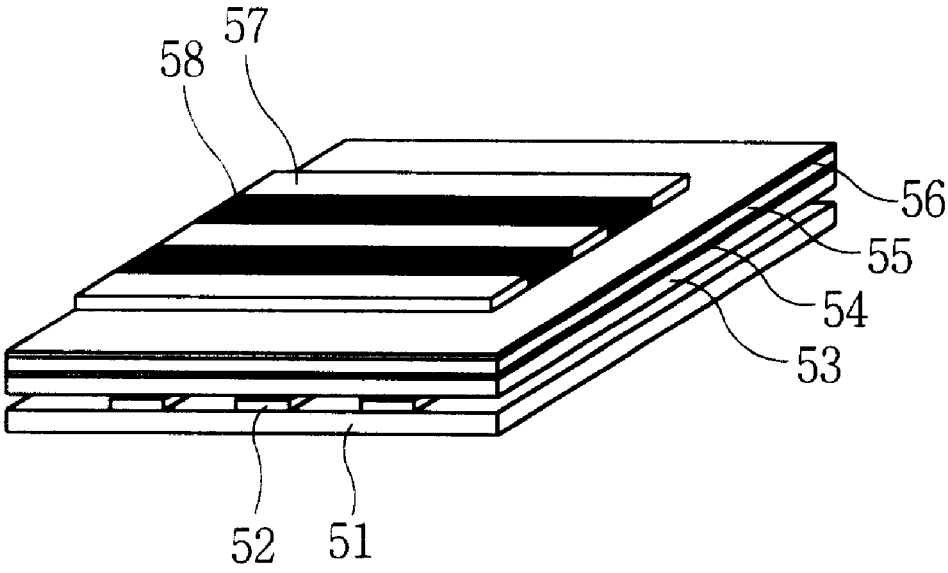

Therefore, as shown in FIG. 7E, by forming color filters 57 used as electrodes on the thin film dielectric 56 and forming a black matrix 58 consisting of main glass and a $Co_2O_3$ oxide filler between the color filters, the SSD with color filters used as electrodes capable of increasing the color purity and effectively shutting off external light reflection.

Here, the method for manufacturing a color filter used as an electrode for the SSD is identical to the method for manufacturing a color filter used as an electrode for the PDP.

Consequently, in the SSD with color filters used as electrodes in accordance with the present invention, the light transmittance and optical efficiency are increased, and the color purity is increased and external light reflection is effectively shut off. In addition, the fabrication process is simple and accordingly the production yield is increased for thereby reducing the manufacturing cost.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A display device, comprising:

a first substrate; and a layer adjacent said first substrate and including a transparent electrode and a color filter, wherein material forming the color filter and material forming the transparent electrode are mixed within said layer.

2. The device of claim 1, wherein said layer further includes:

a first anti-reflective segment formed on a first side of the color filter.

3. The device of claim 2, wherein the first anti-reflective segment includes a black matrix.

4. The device of claim 3, wherein said layer further includes:

a second anti-reflective segment formed on a second side of the color filter.

5. The device of claim 4, wherein the second anti-reflective segment includes a black matrix.

6. The device of claim 4, wherein the first side and the second side are on opposite sides of the color filter.

7. The device of claim 1, wherein said layer further includes:

a plurality of additional color filters; and a plurality of additional transparent electrodes, wherein material forming said additional color filters is mixed with material forming respective ones of the additional transparent electrodes.

8. The device of claim 7, wherein said layer further includes:

a plurality of anti-reflective segments between the color filters, respectively.

9. The device of claim 8, wherein each of the anti-reflective segments include a black matrix.

10. The device of claim 1, wherein the material forming the transparent electrode is a conductive oxide.

11. The device of claim 1, further comprising:

a second substrate; and a light-emitting material between the first substrate and the second substrate, wherein the light-emitting material emits light through the first substrate.

12. The device of claim 11, further comprising:

a sustain electrode adjacent the second substrate, wherein the transparent electrode is an address electrode.

13. A plasma display panel, comprising:

a back substrate;

an upper substrate;

at least one sustain electrode adjacent the back substrate;

at least one color filter; and at least one transparent address electrode, wherein the color filter and the transparent address electrode are adjacent the upper-substrate, and wherein material forming the transparent address electrode includes material forming the color filter.

14. The plasma display panel of claim 13, the material forming the transparent address electrode is a conductive oxide.

15. A display device, comprising:

a first substrate; and transparent electrode means, over the first substrate, for carrying a signal, wherein material forming the transparent electrode means includes material forming a color filter.

16. The display device of claim 15, wherein the display device is a solid state display device.

17. The display device of claim 16, wherein the transparent electrode means is an address electrode.

18. The display device of claim 17, further comprising:

a second substrate; and a back electrode adjacent the second substrate.

19. The display device of claim 15, wherein the material forming the transparent electrode means is a conductive oxide.

20. The display device of claim 15, further comprising:

an anti-reflective segment adjacent the transparent electrode means.

21. The display device of claim 15, further comprising:

anti-reflective segments adjacent opposing sides of the transparent electrode means.

22. The display device of claim 20, wherein the ant-reflective segment includes a black matrix.

* * * * *